US005134942A

United States Patent [19]

Turnwald

[11] Patent Number: 5,134,942

[45] Date of Patent: Aug. 4, 1992

[54] SHELF

[76] Inventor: Peter Turnwald, Zum Pfaffenberg 22, D-6648 Wadern-Lockweiler, Fed. Rep. of Germany

[21] Appl. No.: 675,014

[22] Filed: Mar. 22, 1991

Related U.S. Application Data

[63] Continuation of Ser. No. 385,710, Jul. 26, 1989, abandoned.

[30] Foreign Application Priority Data

Aug. 4, 1988 [DE] Fed. Rep. of Germany ..... 8809941

[51] Int. Cl.[5] ..... A47B 85/00

[52] U.S. Cl. ..... 108/24; 312/128; 211/126

[58] Field of Search ..... 211/59.2, 71, 74, 126, 211/128, 182, 184, 153; 350/126, 128, 350; 108/111, 24, 161, 901; 312/128; 4/656

[56] References Cited

U.S. PATENT DOCUMENTS

| | | | |
|---|---|---|---|
| 2,247,597 | 7/1941 | Bofenkamp | 312/128 |
| 2,884,139 | 4/1959 | Dunham | 211/184 |
| 3,704,792 | 12/1972 | Wiese | 211/126 |
| 4,131,203 | 12/1978 | Bridges | 211/126 |
| 4,611,720 | 9/1986 | Staab | 211/60.1 |
| 4,693,382 | 9/1957 | Galan | 312/350 |

*Primary Examiner*—Gerald A. Anderson
*Attorney, Agent, or Firm*—Peter K. Kontler

[57] ABSTRACT

A shelf for storage of cylindrical and/or other merchandise in stores has a polygonal frame with two spaced apart inverted V-shaped frame members and a grate which slopes downwardly from the inner wall of one frame member to the inner wall of the other frame member at an angle of 5°-10° to the horizontal. The grate is or can be integral with the frame members and comprises a number of elongated parallel grate bars extending between the two frame members and having rounded upper sides. One or more partitions can be employed to divide the space above the grate into two or more compartments. Each such partition has extensions receivable in sockets adjacent the lower marginal portions of the inner legs of the frame members, and one or more clamps for attachment to one or two adjacent grate bars.

14 Claims, 3 Drawing Sheets

SHELF

This application is a continuation of application Ser. No. 385,710 filed Jul. 26, 1989now abandoned.

BACKGROUND OF THE INVENTION

The invention relates to shelves in general, and more particularly to improvements in shelves of the type wherein a frame surrounds a grate serving to support commodities, e.g., merchandise in a store or in a similar establishment. Still more particularly, the invention relates to improvements in grates of the type wherein an endless (e.g., polygonal) frame surrounds a grate and preferably carries plugs and sockets for convenience of stacking with similar or identical shelves.

OBJECTS OF THE INVENTION

An object of the invention is to provide a shelf which is constructed and assembled in such a way that the commodities which are placed onto its grate are compelled to assume predetermined positions.

Another object of the invention is to provide a shelf which can be readily converted for storage of a single class of commodities, such as merchandise, or for storage of two or more different categories of merchandise.

A further object of the invention is to provide a shelf which can be used by itself or in conjunction with one or more additional shelves.

An additional object of the invention is to provide the shelf with a novel and improved frame and with a novel and improved grate.

Still another object of the invention is to provide a novel and improved partition for use with the above outlined shelf.

A further object of the invention is to provide a shelf which can be put to use in any one of several different orientations.

An additional object of the invention is to provide a shelf which can be mass-produced in available machines.

SUMMARY OF THE INVENTION

The invention is embodied in a shelf for storage of merchandise and the like. The improved shelf comprises a frame having two spaced-apart frame members, and a grate which extends between the frame members and, when the shelf is put to use, is inclined in a direction from one of the frame members toward the other frame member. This imparts to merchandise on the grate the tendency to slide or roll in the direction of downward inclination of the grate.

The grate preferably comprises a plurality of parallel elongated grate bars which are preferably coplanar and extend between the two frame members. The inclination of the grate to the horizontal is preferably between 5° and 10°, most preferably 6° to 8°. This enables cylindrical or similar commodities to roll toward and to come to rest at the other frame member or to be arrested by the commodity or commodities adjacent the other frame member. It is preferred to employ grate bars which have rounded (convex) upper sides.

Each frame member can have an inverted V-shaped cross-sectional outline, and each such frame member can include an outer wall or leg more distant from the other frame member and an inner wall or leg. One of the inner walls is or can be shorter than the other inner wall, and the grate bars extend between such inner walls. The longer inner wall is preferably normal or substantially normal to the common plane of the grate bars. The shorter inner wall is or can be substantially vertical.

The lower marginal portions of the inner walls of the two frame members can be provided with pockets or sockets, and the shelf can further comprise at least one partition with two extensions each of which is receivable in a different socket. Such partition or partitions can divide the area for storage of commodities into two or more sections or compartments. The sockets at the lower marginal portions of inner walls of the two frame members preferably have open tops so that the preferably downwardly extending extensions of the at least one partition can be readily introduced into the respective sockets. The main portion or panel of the partition is preferably disposed in a first plane, and the extensions can be disposed in second planes at right angles to the first plane. Each such extension can be located at one of the two longitudinal ends of the at least one partition.

The sockets and the respective extensions can be provided with complementary male and female detent elements to releasably hold the at least one partition in the frame. The male detent elements can include rounded or otherwise configurated protuberances on the extensions. Alternatively, the extensions can have substantially hook-shaped male detent elements which can be introduced into openings of the respective sockets.

The at least one partition can further comprise at least one clamp which releasably engages at least one grate bar intermediate the two frame members. The partition preferably includes at least two clamps. Each clamp can be provided with at least one protuberance which is engageable with the underside of the at least one grate bar.

The novel features which are considered as characteristic of the invention are set forth in particular in the appended claims. The improved shelf itself, however, both as to its construction and the mode of using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
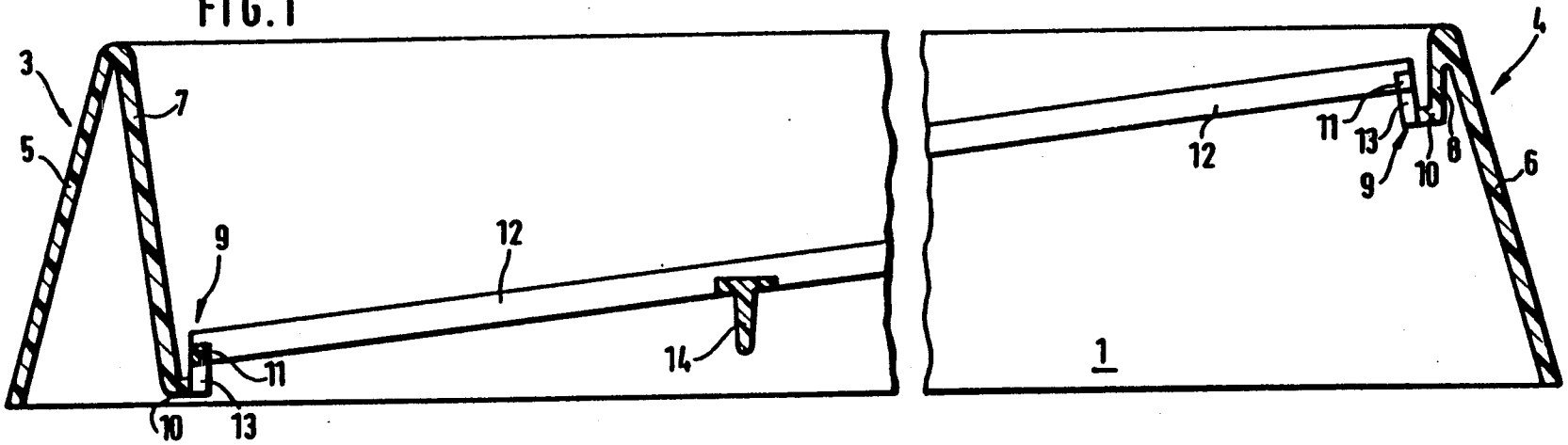
FIG. 1 is a transverse vertical sectional view of a shelf which embodies one form of the invention, the section being taken in the direction of arrows as seen from the line I—I of FIG. 1.
Figure 3:
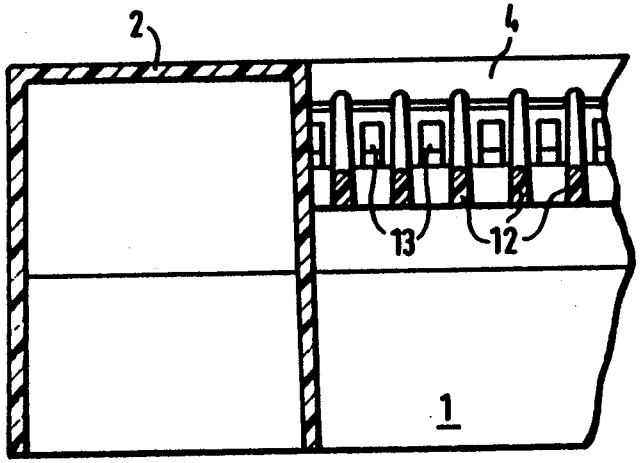
FIG. 3 is a fragmentary longitudinal vertical sectional view substantially as seen in the direction of arrows from the line III—III of FIG. 2.
Figure 2:
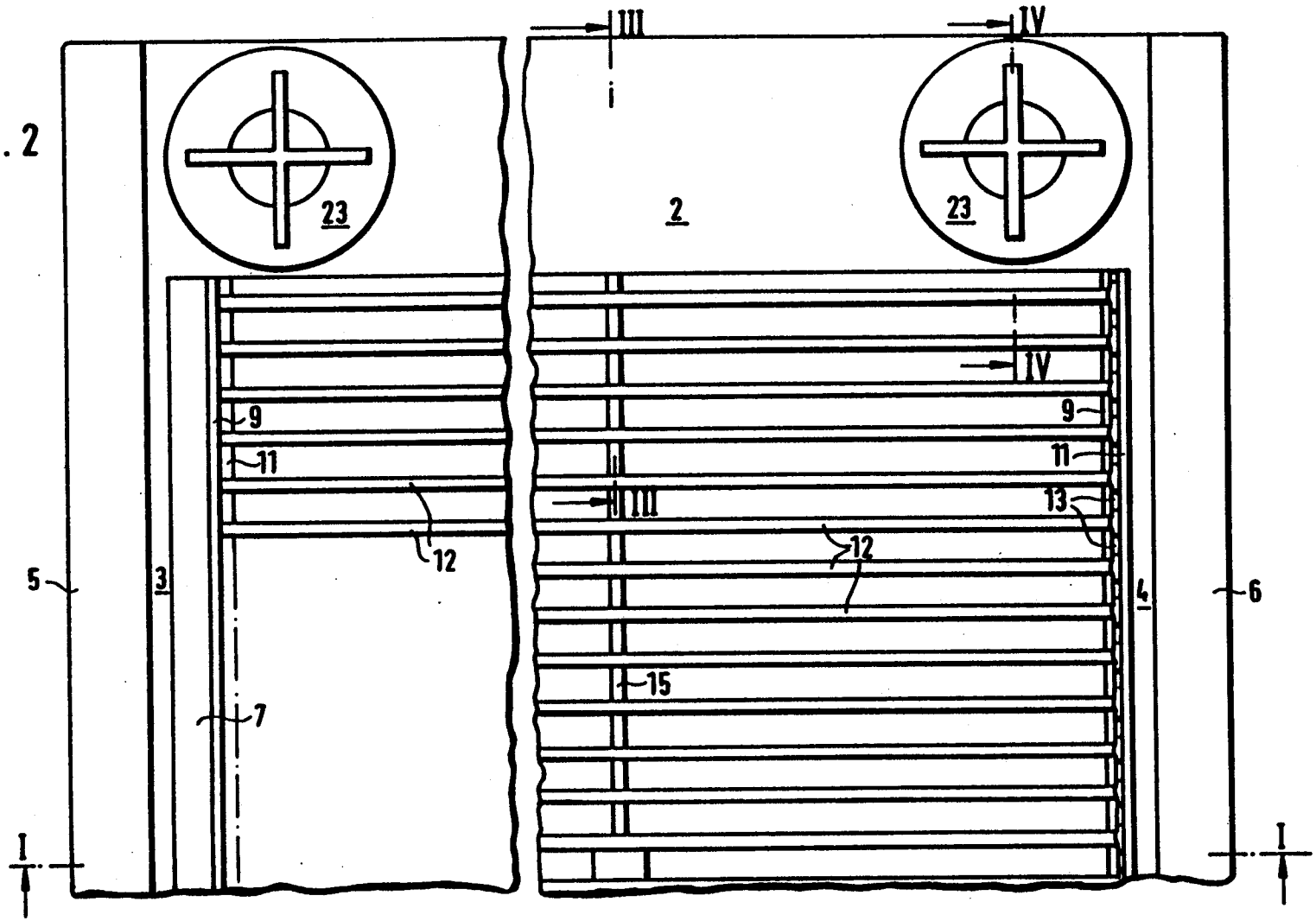
FIG. 2 is a fragmentary plan view of the shelf.
Figure 4:
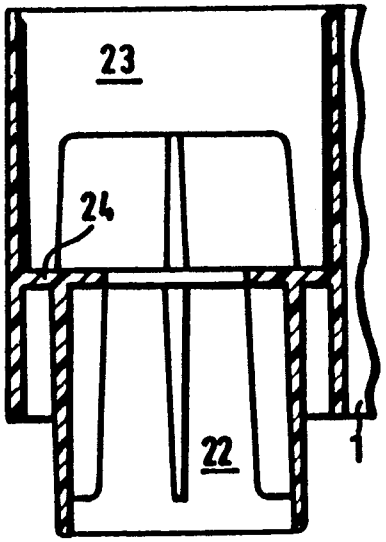
FIG. 4 is an enlarged fragmentary vertical sectional view substantially as seen in the direction of arrows from the line IV—IV of FIG. 2.

The one-piece shelf which is shown in FIGS. 1 to 4 comprises a circumferentially complete rectangular frame 1 with two parallel longer frame members 3, 4 and two parallel shorter frame members 2 (only one shown). Each of the two shorter frame members 2 has an inverted U-shaped cross-sectional outline (see FIG. 3), and each of the two longer frame members 3, 4 has an inverted V-shaped cross-sectional outline (see FIG. 1).

The outer walls 5, 6 of the frame members 3, 4 are mirror symmetrical to each other and are inclined to the vertical at angles of 15°. The inner wall 7 of the frame member 3 is inclined to the vertical at an angle of 7° (i.e., the angle between the walls 5 and 7 is approximately 22°). The inner wall or panel 8 of the frame member 4 is vertical.

The lower marginal portion of the inner wall 7 defines a first socket or pocket 9 which is bounded by two sections 10, 11. A similar pocket or socket 9 is defined by the lower marginal portion of the inner wall 8. The section 10 of the socket 9 of the wall 7 is normal to the major portion of this wall, and the other section 11 of this socket is vertical. The upper portion of that side of the section 11 of the left-hand socket 9 of FIG. 1 which confronts the major portion of the inner wall 7 is slightly bevelled (e.g., at an angle of approximately 2° to the vertical). The second section 11 of the right-hand socket 9 of FIG. 1 is inclined to the vertical at an angle of approximately 7°.

The shelf of FIGS. 1 to 4 further comprises a grate which is composed of a plurality of elongated parallel grate bars 12 each of which has a rounded (convex) upper side. The common plane of the grate bars 12 is inclined to the horizontal at an angle of approximately 7°. The end portions of the grate bars 12 project slightly above the respective sections 11, and the end faces of upwardly projecting portions of the bars 12 are flush with the adjacent inner sides of the respective sections 11.

The sections 11 are provided with openings (female detent elements) 13 which are disposed between and at levels below the neighboring pairs of grate bars 12. This can be seen in FIGS. 1 and 3. Each opening 13 extends all the way through the respective section 11 in a direction toward the major portion of the respective inner wall 7, 8, and each opening 13 extends all the way to the underside of the respective socket 9.

The grate further includes two reinforcing ribs or rails 14, 15 which extend between the two shorter frame members 2 beneath and at right angles to the bars 12.

The shelf also comprises four round sockets 23 which are provided in the end portions of the longer frame members 3, 4 and each of which is in line with a downwardly extending plug 22. The plugs 22 extend downwardly from the bottom walls 24 in the respective sockets 23. Each plug 22 is receivable, preferably with a certain amount of friction, in one socket 23 of an adjoining shelf. Neighboring shelfs can be stacked on top of each other in such orientation that their grates are inclined in the same direction or that their grates are inclined in opposite directions. In other words, the frame member 3, 4 of one shelf can be disposed above or below the frame members 3, 4 of a neighboring shelf, or the frame members 3, 4 of a shelf can be disposed above or below the frame members 4, 3 of a neighboring shelf.

The length of the frame members 2 can match that of the frame members 3, 4, i.e., the improved shelf can have a square outline.

Figure 5:
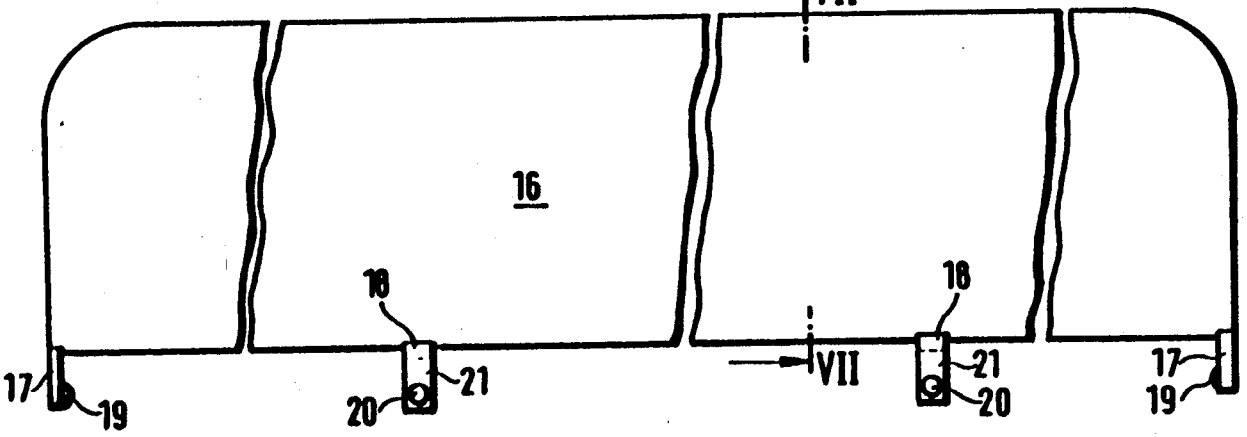
FIG. 5 is an elevational view of a partition which can be used in the shelf of FIGS. 1 to 4.
Figure 7:
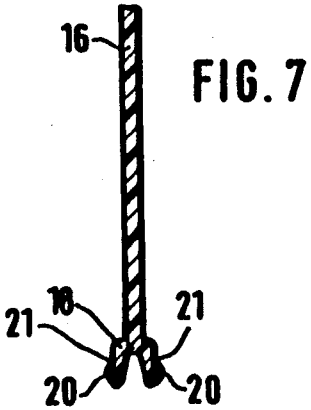
FIG. 7 a sectional view as seen in the direction of arrows from the line VII—VII of FIG. 5.
Figure 6:
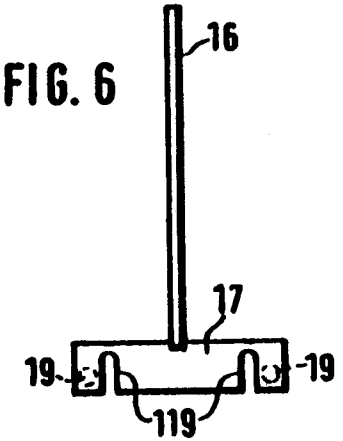
FIG. 6 is an end elevational view of the partition.

FIGS. 5 to 7 show a partition 16 which can be used with the frame 1 of the improved shelf. The end portions of the elongated main portion or panel of the partition 16 have extensions 17 which can be said to constitute legs and are disposed in planes extending at right angles to the plane of the main portion of the partition. In addition, the panel or main portion of the partition 16 carries two clamps 18 which extend beyond the lower edge face of the panel and can releasably engage a pair of neighboring grate bars 12 when the partition 16 is secured to the frame 1 so as to divide the space above the grate into two identical or differently dimensioned compartments.

Each extension or leg 17 has two spaced-apart rounded protuberances 19 (FIG. 6) which constitute male detent elements and can snap into the adjacent openings 13 (female detent elements) to releasably hold the partition 16 at a selected distance from the frame members 2. Furthermore, each extension 17 has two slots 119 which are inwardly adjacent the protuberances 19 to enhance the flexibility of those portions of the extensions which carry such protuberances. The slots 119 are shown in FIG. 6. The pockets or sockets 9 of the frame members 3, 4 are designed with a view to receive the extensions 18 of the partition 16. The improved shelf can be furnished with two or more partitions 16, depending upon the size of the frame 1 and upon the desired number of compartments above the grate bars 12.

The clamps 18 are bifurcated and each of their prongs 21 carries an outwardly extending protuberance 20 which can engage the underside of an adjacent grate bar 12 to releasably lock the clamp thereto. Thus, each clamp 18 is coupled to two neighboring bars 12 when it is properly inserted between them. The prongs 21 impart the necessary elasticity which enables the clamp 18 to penetrate into the space between two neighboring grate bars 12 before the protuberances 20 are free to move apart and to engage the undersides of the respective grate bars.

The merchandise which is placed onto the properly positioned shelf (i.e., onto a shelf wherein the grate including the grate bars 12 is inclined to the horizontal at an angle of 5°-10° (preferably between 6°-8°) tends to slide or roll, or actually slides or rolls, in a direction from the inner wall 8 of the frame member 4 toward the inner wall 7 of the frame member 3 and is ultimately arrested by the inner wall 7.

If the shelf is positioned in such a way that the frame member 3 is located in front of the frame member 4, the merchandise on the grate bars 12 tends to slide or roll toward the person or persons standing or sitting in front of the frame member 3. In other words, if merchandise is removed from the grate immediately behind the frame member 3, the thus developed empty spaces are automatically refilled with merchandise which slides or rolls toward the inner wall 7. In addition, the merchandise is readily observable because it tends to gather immediately behind the frame member 3. Thus, it is not necessary to reach far for the merchandise on the grate bars 12 because the merchandise tends to move forwardly toward the frame member 3 and is also visible behind the inner wall 7. This enables the person in charge to ascertain, at a glance, whether or not the supply of merchandise on the shelf is exhausted.

On the other hand, if the owner or a manager of the establishment in which the improved shelf is put to use decides that it is advisable to keep the merchandise out of sight or further away from the front part of the shelf, the frame member 4 is placed in front of the frame member 3 so that the merchandise on the grate bars 12 tends to or actually slides or rolls away from the person standing or sitting in front of the frame member 4. Thus, the improved shelf can be put to use in two different positions or orientations at 180° to each other. An advantage of a shelf wherein the frame member 4 is located in front of the frame member 3 is that the shelf can be more readily restocked with merchandise because the merchandise which is deposited behind the front frame member 4 tends to or actually slides or rolls away from the frame member 4 to come to a halt on reaching the inner wall 7 of the rear frame member 3 or after it strikes a commodity which is adjacent the frame member 3. Such orientation of the shelf is of advantage when the shelf is located at a level where the quantity of merchandise on the grate can be readily observed and the merchandise is within reach even if it is adjacent the rear frame member 3.

An advantage of the grate with parallel grate bars 12 having rounded upper sides is that such grate collects little or no dust and/or other foreign matter. Moreover, the rounded upper sides of the grate bars 12 promote the tendency of the merchandise to slide or roll from the shorter inner wall 8 toward the longer inner wall 7. As a rule, the shelf will be made from a suitable plastic material, and the coefficient of friction and the finish of plastic material can be selected with a view to ensure that the merchandise which is to be stored on the shelf will exhibit a desired tendency to slide or roll toward the lower end of the grate.

The exposed surfaces of the outer walls 5 and 6 can serve as carriers of information pertaining to the nature and/or cost of stored merchandise and also as carriers of advertising material. The slight inclination of such outer walls renders it even more convenient to read the information which is applied to their outer sides.

In order to facilitate immediate determination of the extent of occupancy of the grate, at least the frame members 3, 4 of the frame 1 are or can be made of a transparent or translucent material. However, it is equally within the purview of the invention to make the shelf of a colored plastic material or to use a tinted material which transmits light but nevertheless exhibits a desired color shade. The information on the frame member 3 and/or 4 need not completely cover the outer side of the respective outer wall 5 or 6; this facilitates a determination of the extent of occupancy of the grate by looking through the frame member 3 or 4 (depending upon which of these frame members is located in front of the other).

The improved partition 16 or an analogous partition can be used with advantage in conjunction with standard shelves which do not embody inclined grates. The length of the extensions 17 determines the stability of the properly installed partition 16. As mentioned above, such extensions are received in the respective sockets 9 and their protuberances 19 snap into the adjacent openings 13. The protuberances 19 are optional but highly desirable because they enhance the stability of the partition 16 in inserted position and prevent a tilting or overturning of the partition under the impact of merchandise which is caused or permitted to slide or roll along the grate until arrested by the partition. The protuberances 19 can be dimensioned and/or configurated in such a way that they ensure more or less permanent attachment of the partition 16 to the frame 1. For example, each protuberance can constitute or resemble a hook or a like part which, once having entered the adjacent opening 13, more or less permanently couples the partition to the frame. The hook-shaped protuberances need not extend sideways but can also extend (at least in part) downwardly to enter into and extend through and beyond complementary female detent elements of the respective sockets 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A shelf for use as one of a plurality of superimposed shelves for the displaying of merchandise and the like, comprising a circumferentially complete frame at least having spaced-apart first and second frame members, each of said frame members having an inverted V-shaped cross-sectional outline and each of said frame members including an inner wall and an outer wall, one of said inner walls being shorter than the other said inner walls; and a grate extending between said frame members and being downwardly inclined with reference to a horizontal plane in a direction from said first frame member toward said second frame member, said grate consisting of a plurality of coplanar elongated grate bars which extend between said inner walls and said inclined grate bars supporting merchandise for display on the shelf so that said merchandise tends to advance by gravity from said first frame member toward said second frame member.

2. The shelves of claim 1, wherein said coplanar grate bars of each shelf are disposed in a predetermined plane and said other inner wall is substantially normal to the respective predetermined plane.

3. The shelves of claim 2, wherein said one inner wall is substantially vertical.

4. A shelf for the displaying of merchandise and the like comprising a circumferentially complete frame having at least two spaced-apart frame members, each of said frame members having an inverted V-shaped cross-sectional outline and each of said frame members including an outer wall and an inner wall, one of said inner walls being shorter than the other of said inner walls, said inner walls having lower marginal potions and having sockets extending along said lower marginal portions; at least one partition having two extensions, each extension of each partition removably received in the socket of one of said lower marginal portions to partition the shelf; and a grate extending between said two spaced-apart frame members and being inclined relative to a horizontal plane and in a direction from said frame member having said shorter inner wall toward the other of said spaced-apart frame members, said grate consisting of a plurality of coplanar elongated parallel grate bars which extend between said inner walls substantially at right angles to said sockets, said inclined grate supporting merchandise for display on the shelf so that said merchandise tends to advance by gravity from said shorter inner wall toward the other inner wall.

5. The shelves of claim 1, wherein the inclination of each grate to said horizontal plane is between 5° and 10°, preferably 6° to 8°.

6. The shelves of claim 1, wherein said grate bars have substantially convex upper sides.

7. The shelf of claim 4, wherein said sockets have open tops and said extensions project downwardly from said at least one partition.

8. The shelf of claim 4, wherein said at least one partition includes a panel disposed in a first plane and having two end portions, said extensions being disposed in second planes at right angles to said first plane and said extensions being disposed at different ends of said panel.

9. The shelf of claim 4, wherein said sockets and the respective extensions have complementary male and female detent elements to releasably hold said at least one partition in said frame.

10. The shelf of claim 9, wherein said male detent elements include protuberances on said extensions.

11. The shelf of claim 4, wherein said extensions substantially hook-shaped male detent elements and said sockets have openings for the respective male detent elements.

12. The shelf of claim 4, wherein said at least one partition includes at least one clamp releasably engaging at least one of said grate bars intermediate said frame members.

13. The shelf of claim 12, wherein said partition includes at least two clamps.

14. The shelf of claim 12, wherein said at least one clamp has at least one protuberance engageable with the underside of said at least one grate bar.

* * * * *